United States Patent [19]

Johnson

[11] Patent Number: 4,581,557

[45] Date of Patent: Apr. 8, 1986

[54] STABILIZED HIGH INTENSITY DISCHARGE LAMP

[75] Inventor: Peter D. Johnson, Schenectady, N.Y.

[73] Assignee: General Electric Company, Schenectady, N.Y.

[21] Appl. No.: 196,650

[22] Filed: Oct. 14, 1980

Related U.S. Application Data

[63] Continuation of Ser. No. 336, Jan. 2, 1979, abandoned.

[51] Int. Cl.[4] ..... H01J 61/20; H01J 61/24; H01J 61/28

[52] U.S. Cl. ..... 313/25; 313/552; 313/565; 313/639

[58] Field of Search ..... 313/174, 229, 184, 227, 313/25, 552, 565, 639

[56] References Cited

U.S. PATENT DOCUMENTS

| | | | |
|---|---|---|---|
| 2,275,768 | 3/1942 | Kern et al. | 313/25 X |
| 2,659,833 | 11/1953 | Anderson, Jr. | 313/184 X |
| 3,379,916 | 4/1968 | Delrieu et al. | 313/25 X |
| 3,392,298 | 7/1968 | Menelly | 313/227 X |
| 3,781,586 | 12/1973 | Johnson | 313/229 X |
| 3,882,345 | 5/1975 | Kazek et al. | 313/229 |
| 3,995,928 | 12/1976 | Shaffner et al. | 313/184 X |
| 4,015,162 | 3/1977 | Evans et al. | 313/174 X |
| 4,035,682 | 7/1977 | Bubar | 313/174 |
| 4,161,672 | 7/1979 | Cap et al. | 313/229 X |

FOREIGN PATENT DOCUMENTS

| | | | |
|---|---|---|---|
| 131477 | 12/1929 | Austria . | |
| 264553 | 9/1912 | Fed. Rep. of Germany . | |
| 711871 | 9/1941 | Fed. Rep. of Germany . | |
| 431450 | 7/1935 | United Kingdom . | |
| 966608 | 8/1964 | United Kingdom . | |
| 1192999 | 5/1970 | United Kingdom . | |
| 1248157 | 9/1971 | United Kingdom . | |
| 1280990 | 7/1972 | United Kingdom . | |
| 1304335 | 1/1973 | United Kingdom . | |
| 1423563 | 2/1976 | United Kingdom . | |
| 1522330 | 8/1978 | United Kingdom . | |
| 351262 | 2/1976 | U.S.S.R. | 313/229 |

*Primary Examiner*—Palmer C. DeMeo

*Attorney, Agent, or Firm*—Lawrence D. Cutter; James C. Davis, Jr.; Marvin Snyder

[57] ABSTRACT

An amalgam is disposed within the arc tube of a high intensity arc discharge lamp so as to stabilize the electrical power being supplied to the lamp against variations in line voltage. The vapor pressure of mercury in the arc tube varies as a function of the lamp temperature which depends in turn on applied lamp voltage. The resulting change in arc voltage due to corresponding changes in mercury pressure operates to restore the power input to its approximate original value.

6 Claims, 1 Drawing Figure

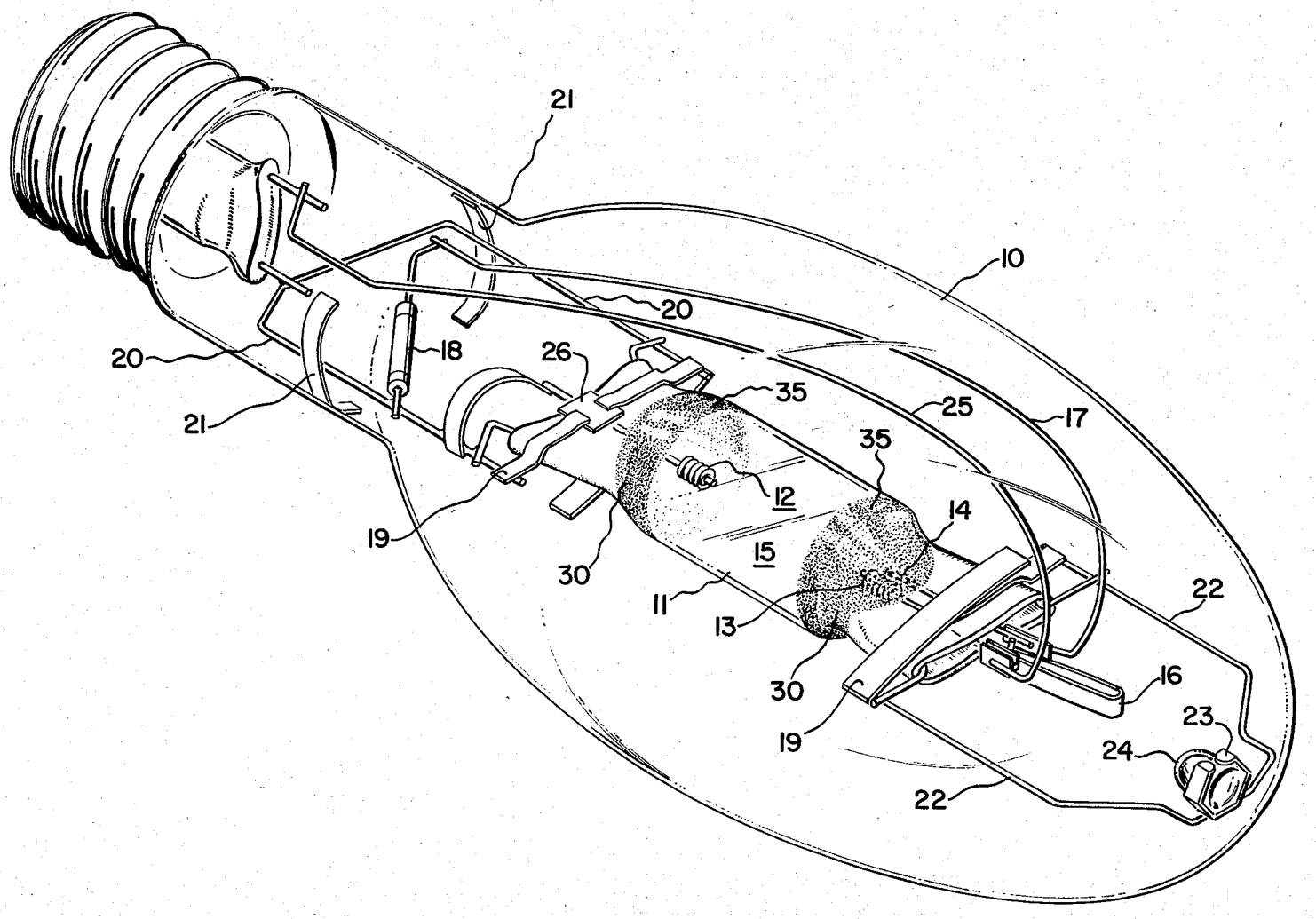
10
11
12
13
14
15
16
17
18
19
20
21
22
23
24
25
26
30
35

STABILIZED HIGH INTENSITY DISCHARGE LAMP

This is a continuation of application Ser. No. 000,336, filed Jan. 2, 1979, and now abandoned.

BACKGROUND OF THE INVENTION

This invention relates to high intensity discharge lamps and in particular to such lamps which include an amalgam for self-regulation of input power in spite of line voltage changes.

At present, power regulation in high intensity arc discharge lamps requires relatively complicated and expensive electronics. There is no mechanism internal to the lamp for compensating for such line fluctuations which do occur regularly on conventional alternating current power lines.

In conventional high intensity discharge lamps in which the gaseous discharge medium comprises a mixture of a rare gas and mercury or rare gas along with mercury and a metal halide vapor, the mercury vapor pressure is limited. That is, all of the mercury in the arc tube is vaporized. The voltage drop along the arc in these conventional high intensity discharge lamps is determined by the mercury vapor pressure and is constant and is essentially proportional to the amount of mercury between the electrodes, that is, the mercury vapor density. Since this is fixed and limited by the amount of mercury originally incorporated into the lamp during manufacture, the arc voltage drop is constant for a given applied voltage. However, along with line voltage fluctuations, the power supplied to the lamp and therefore the intensity of the light output from the lamp varies. This variance of light output from the lamp is highly undesirable and as mentioned above is controllable only through expensive electronics.

In some fluorescent lamps, amalgams are used to control the mercury vapor pressure to achieve optimum production of 254 nanometer ultraviolet radiation. This control, however, is not accompanied by any change in the electrical characteristics of the arc discharge; the change in pressure is related only to the optical characteristics of the plasma to insure maximum production of the resonance radiation. Amalgams, however, have not been employed in high intensity discharge lamps.

SUMMARY OF THE INVENTION

In accordance with a preferred embodiment of the present invention, a high intensity arc discharge lamp contains within its arc tube an amalgam acting to stabilize the electrical power supply to the lamp against variations in applied lamp voltage. With such an amalgam present, a change of impressed voltage results in a temporary change in power input which alters the temperature of the amalgam thereby increasing the mercury vapor pressure and correspondingly the effective lamp resistance. This increase in lamp resistance increases the voltage drop across the arc and produces a corresponding drop in the arc current and a drop in the power supplied to the lamp thereby eventually dropping the lamp temperature and mercury pressure back to approximate design levels. This power regulation cycle is preferably enhanced through the use of a small series ballast resistor or inductor.

Accordingly, it is an object of the present invention to provide a high intensity arc discharge lamp having self-regulating power control through the use of an amalgam incorporated within the arc tube.

DESCRIPTION OF THE DRAWING

The FIGURE is a perspective view of a high intensity discharge lamp in accordance with a preferred embodiment of the present invention in which an amalgam is disposed in the arc tube.

DETAILED DESCRIPTION OF THE INVENTION

The FIGURE illustrates a conventional high intensity arc discharge lamp incorporating an amalgam in accordance with the present invention. While shown with an Edison, screw-in base, these lamps may incorporate other appropriate bases, sized and configured for particular sockets and luminaires. Additionally, special ballasting circuits are required for the typical lamp of the present invention. Supported within outer transparent envelope 10, which typically comprises a relatively standard glass material, there is centrally disposed arc discharge tube 11 which typically comprises quartz or a transparent or translucent (that is, light-transmissive) ceramic material capable of withstanding temperatures in excess of 500° C. Disposed within the arc discharge envelope 11 are electrodes 12 and 13 at opposite ends of said envelope 11 which typically possesses an elongate cylindrical shape, flattened at either end. Also disposed at one end of said envelope 11 is starting electrode 14 disposed a short distance from one of the electrodes so as to facilitate an initial ionization of the vapor 15 contained within the envelope 11. The vapor 15 comprises a rare gas, such as argon, mercury vapor, and in some cases a metal halide vapor. The excitation of this vapor 15 by the passage of current through it between electrodes 12 and 13, is responsible for production of the output of the visible wavelength photons.

The lamp is usually started through ionization of vapor 15 between electrode 13 and starting electrode 14. This initial ionization facilitates ionization of a substantial portion of the vapor 15 and leads to an increasing discharge through the entire interior volume of envelope 11 and the passage of a discharge current between electrodes 12 and 13. The resultant discharge heats the tube and eventually, bimetallic strip 16 acts to electrically connect electrodes 13 and 14 so as to reduce electrolysis of the halides.

Strip member 19 connected to support members 20 and 22 have deposited on them gettering material which acts to remove gases such as oxygen from the volume contained between the inner envelope 11 and the outer envelope 10. Support member 20 is typically connected to one side of the power supply and has spring members 21 spot welded thereto for increased support for the inner lamp structure consisting essentially of transparent quartz envelope 11. The quartz envelope 11 is also supported from the other end of outer envelope 10 by means of dimple 24 in envelope 10, said dimple 24 providing an attachment structure for hexagonal band 23 to which support structure 22 is attached. Support structures 20 and 22 are typically attached by spot welding to straps snuggly fixed to flattened ends of envelope 11. A support structure such as that shown in the FIGURE is typical and provides a sufficiently rigid support for arc discharge tube 11 and its associated structures. Each end of arc tube 11 is sealably closed and electrical feedthroughs are provided by means of a molybdenum foil sheet 26 forming a gas-tight seal with the glass envelope 11 at each of its pinched ends. Foil structure 26 is however visible in the illustration only at the end of the arc tube 11 in which electrode 12 is disposed. Additionally, in the FIGURE, return lead 25 is shown and is connected to one terminal of the power supply and to electrode 13. Also, each end of the discharge tube 11 is preferably coated with an opaque relective coating such as zirconium oxide ($ZrO_2$) acting as a heat-conserving reflective coat which assists in maintaining the discharge tube temperature at suitably high level.

In accordance with a preferred embodiment of the present invention, the arc discharge tube also has coated thereon an amalgam composition 35 preferably disposed as shown. The degree of self-regulation provided by the amalgam is optimized by selecting an amalgam in which $dP_{Hg}/dT_p$ is as large as possible at the amalgam temperature, $T_p$. There is a large selection of metals such as copper, zinc, cadmium, gallium, indium, thallium, antimony, and silver which result in suitable amalgams for the desired amalgam temperature selected on the basis of vapor pressure requirements of other arc tube ingredients. The mercury vapor present in the lamp during normal operation is typically provided both from the amalgam coat on the arc tube interior applied during lamp manufacture and from liquid mercury typically added as a globule during the manufacturing process. In particular, indium amalgam wets well to the glass arc tube 11. The amalgamating metal is added to the arc tube in any convenient manner prior to final tube sealing. The mercury is added either as a globule, in vapor form, as an amalgam with the amalgamating metal or as a combination of the foregoing. In any event, an amalgam coat forms on the arc tube wall at its coolest points, particularly near the ends of the tube.

The self-regulatory operation of the lamp of the present inventon is now described. During normal lamp operation, a small series ballast resistor or inductor is employed typically having a resistance an order of magnitude below the resistance of the lamp itself which is determined by the arc current and voltage drop across the arc. For relatively small fluctuations in line voltage, there is a corresponding increase in power supplied to the lamp. This increased lamp power results in a higher lamp temperature which, now because of the presence of an amalgam produces a significantly larger partial pressure of mercury vapor which in turn causes the lamp to exhibit a higher effective resistance and a correspondingly larger increase in the voltage drop across the arc discharge and a drop in arc current, because of the presence of the small ballast impedance. Thus, eventually, in a relatively short time, the lamp power is restored to a level approximating its orginal value prior to the line voltage increase. A numercial example of these changes is provided below.

Physically large discharge lamps have a slow response to changes in power line voltage because of the correspondingly high energy density requirements for increasing their temperature and, therefore, these lamps function in a less satisfactory manner than smaller lamps also incorporating an amalgam for power regulation. However, smaller discharge lamps, such as for example, lamps having a wattage rating of approximately 150 watts do exhibit sufficiently small physical dimensions so that rapid changes in lamp temperature do occur in response to line voltage changes. While 100 percent compensation of line voltage changes is not to be usually expected through use of amalgam of the present invention, nonetheless, the lamp power relaxes to a value between an initial condition and the condition attained following the line voltage increase. The amalgam composition and location within the arc tube structure is selected to be such that the derivative of the lamp voltage with respect to line voltage is greater than or equal to one in order to maintain constant power levels in the lamp with changes in line voltage. However, values of this derivative less than unity, but positive, and substantially greater than zero are useful in reducing the compensation required in the electronic ballast. Thus, even if 100 percent compensation is not attained, the lamps of the present invention permit a greater flexibility in ballast design and the employment of less expensive ballast circuitry.

The following numerical example is provided to illustrate the self-regulating control provided by the lamp of the present invention. In particular, assume that a lamp exhibiting a resistance of 90 ohms is connected in series with a ballasting resistor of 10 ohms. Thus, with current of 1 amp flowing in the series combination, a total voltage drop of 100 volts results with 10 volts being developed across the ballast resistor and 90 volts across the lamp. Correspondingly, at these current and voltage levels, the lamp power level is 90 watts and the ballast resistor power level is 10 watts. Assume now that there is a voltage fluctuation to a level of 104 volts. After a short period of increased power consumption, the lamp temperature and mercury vapor pressure will increase resulting in an increased lamp resistance. If an approximately 10 percent increase in lamp resistance results to a new resistance of say, for example, 99.8 ohms, the current through the series combination will drop to 0.9526 amps resulting in a voltage drop across the lamp of 94.479 volts and across the ballasting resistor of 9.526 volts. The power now being supplied to the ballasting resistor is 9.526 watts, but the power being supplied to the lamp is still 90.0 watts. The above illustrates a case of ideal 100 percent compensation in which the value of the aforementioned voltage derivative is approximately 1.120, which is in fact greater than 1 as required for such ideal compensation. Greater or lesser changes in the lamp resistance as a result of increase in temperature and mercury vapor pressure will accordingly result in correspondingly greater or lesser levels of compensation.

By way of example, and not limitation, a lamp in accordance with the present invention may be made in accordance with the following specifications. The arc tube comprises a fused quartz material fashioned into an oval shape such as that shown in the FIGURE. The main electrodes, such as 12 and 13, are separated by a distance of approximately 20 millimeters. At its center, the arc tube has an outside diameter of approximately 12 millimeters and an inside diameter of approximately 10 millimeters and encloses an internal volume of approximately 2 cubic centimeters. A starting gas such as argon is employed at a partial pressure of approximately 20 torr. The amalgam disposed on an internal surface of the arc tube comprises 25 milligrams of mercury and 25 milligrams of indium. Such a high intensity discharge lamp exhibits a power rating of approximately 150 watts and is highly self-regulating with respect to maintaining a stable power level in spite of line voltage fluctuations. Additionally, lamps with an internal volume from approximately 0.5 cubic centimers to approximately 5 cubic centimeters are easily manufactured.

During lamp operation the mercury vapor pressure is typically between approximately 0.5 atmospheres and approximately 20 atmospheres with the range of between approximately 1 and approximately 5 atmospheres being preferred.

From the above, it may be appreciated that the present invention provides a high intensity arc discharge lamp structure offering several advantages. In particular, the sensitivity of the light output to line voltage fluctuations is significantly reduced. Additionally, ballasting for the lamp is more flexibly achieved at a lower cost and with reduced complexity. The incorporation of the present invention into existing manufacturing processes is very easily accomplished with minimal cost.

While this invention has been described with reference to particular embodiments and examples, other modifications and variations will occur to those skilled in the art in view of the above teachings. Accordingly, it should be understood that the claims are intended to cover all such modifications and variations that fall within the true spirit of the invention.

The invention claimed is:

1. A high intensity arc discharge lamp, comprising:

an outer light-transmissive envelope surrounding a light-transmissive arc discharge tube having electrodes disposed at opposite ends thereof, said arc tube also containing a gaseous discharge medium including mercury vapor; and a sufficient quantity of mercury amalgam disposed within said arc tube so that in operation a sufficient quantity of mercury remains unvaporized and available to adjust the partial pressure of mercury vapor thereby to stabilize electrical power being supplied to said lamp against variations in applied voltage, said amalgam being substantially free of unalloyed tin.

2. The lamp of claim 1 in which said amalgam comprises mercury alloyed with material selected from the group consisting of copper, zinc, cadmium, gallium, indium, thallium, silver, antimony, and combinations thereof.

3. The lamp of claim 1 in which the arc tube volume comprises approximately 2 $cm^3$, the gaseous discharge medium is contained at a pressure of between approximately 0.5 atmospheres and approximately 20 atmospheres, and the amalgam comprises approximately 25 milligrams of mercury and 25 milligrams of indium.

4. The lamp of claim 1 in which said arc discharge tube is quartz.

5. The lamp of claim 1 further including a series-connected ballast resistor.

6. The lamp of claim 1 in which said arc discharge tube exhibits a volume of between approximately 0.5 $cm^3$ and approximately 5 $cm^3$.

* * * * *